US006387227B1

(12) United States Patent
Hamanaka et al.

(10) Patent No.: US 6,387,227 B1
(45) Date of Patent: May 14, 2002

(54) METAL PLATE ELECTROLYZATION APPARATUS AND ELECTRODE FOR ELECTROLYZING METAL PLATE

(75) Inventors: Tatsuya Hamanaka; Hiromitsu Nonaka, both of Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 16 days.

(21) Appl. No.: 09/709,558

(22) Filed: Nov. 13, 2000

(30) Foreign Application Priority Data

Nov. 12, 1999 (JP) ..... 11-322438

(51) Int. Cl.[7] ..... C25D 17/14

(52) U.S. Cl. ..... 204/206; 204/211; 204/224 R; 204/230.5; 204/267; 204/269; 204/278.5

(58) Field of Search ..... 204/198, 202, 204/203, 204, 206, 207, 211, 225, 227, 224 R, 230.5, 267, 269, 278.5, 280, 286.1, 287, 288.1

(56) References Cited

U.S. PATENT DOCUMENTS 4,390,407 A * 6/1983 Mori et al. ..... 204/206
4,502,933 A * 3/1985 Mori et al. ..... 204/206
5,181,997 A * 1/1993 Kaneko et al. ..... 204/206
5,851,373 A * 12/1998 Kubota et al. ..... 205/324

FOREIGN PATENT DOCUMENTS

JP 62-3240 1/1987

OTHER PUBLICATIONS

Patent Abstracts of Japan 57057896 A Jan. 23, 1987.

* cited by examiner

*Primary Examiner*—Bruce F. Bell
(74) *Attorney, Agent, or Firm*—Sughrue Mion, PLLC

(57) ABSTRACT

An oxidation electrode is formed with a front-surface-side electrode member and a back-surface-side electrode member, and two switches are provided respectively between a power supply and the front-surface-side electrode member and between the power supply and the back-surface-side electrode member. Since the front-surface-side electrode member and the back-surface-side electrode member are separate, an aluminum plate and other structures provided in a anodizing bath do not hinder a replacement of the electrode members, so that the replacement can be carried out easily and at low costs. Since the front-surface-side electrode member and the back-surface-side electrode member can be independently turned on and off for a single side treatment, the energy efficiency can be improved and switching between the single side treatment and the double treatment can be facilitated.

20 Claims, 5 Drawing Sheets

METAL PLATE ELECTROLYZATION APPARATUS AND ELECTRODE FOR ELECTROLYZING METAL PLATE

BACKGROUND OF THE INVENTION

1. Field of the Invention

The present invention relates to a metal plate electrolyzation apparatus for electrolyzing, such as anodizing, a metal plate, and to an electrode for electrolyzing a metal plate.

2. Description of the Related Art

FIG. 5 shows an example of a conventional metal plate electrolyzation apparatus disclosed in Japanese Patent Application Publication (JP-B) No. 62-3240. FIG. 5 partially shows an anodic oxidation apparatus 110 for a belt-like aluminum plate.

In this anodic oxidation apparatus 110, an electrode 116 placed in an electrolyte 114 in an electrolytic bath 112 is connected to a cathode 118 of a power supply via a bus bar 120. Further, the electrode 116 is coupled to an electrode 122 which is positioned in parallel with the electrode 116 by an electrically conductive member 124. When an aluminum plate 126 is continuously run between the electrodes 116 and 122, anodic oxide coatings are formed on front and back surfaces of the aluminum plate 126 (so-called double side treatment).

Generally, in the metal plate electrolyzation apparatus of this type, the electrodes 116 and 122 need to be replaced after a treatment because they are worn and have deteriorated.

Since the electrodes 116 and 122 are formed integrally and are not separable in this anodic oxidation apparatus 110, the entire unit must be replaced. However, since there are generally many unillustrated structures provided within the electrolytic bath 112 in addition to the aluminum plate 126, the aluminum plate 126 and these other structures hinder replacement, and significant labor is required and costs are incurred in replacing the electrodes.

A metal plate electrolyzation apparatus of this type may be used to electrolyze only one surface of the aluminum plate 126 (so-called single side treatment). In this case, placement of an insulation sheet or an insulation plate between the unelectrolyzed surface of the aluminum plate 126 and the electrode is required, and this operation is troublesome. Further, placement or removal of the insulation member is required each time there is switching between a double side treatment and a single side treatment.

Furthermore, since the electrodes 116 and 122 are coupled by the conductive member 124 and an electric current flows to the electrode at the untreated side even in the case of a single side treatment, the flow of the electric current is more than required, resulting in low energy efficiency.

In addition, even when the above described insulation member is included, the electrode at the untreated side also essentially acts as an electrode, and an oxide coating is formed on the untreated surface of the aluminum plate 126 in the vicinity of width-direction ends thereof. As a result, the aluminum plate 126 after treatment has portions having locally increased plate thickness. When the aluminum plate 126 having these thicker portions is wound in a roll, the vicinity of the width-direction ends of the aluminum plate 126 protrude more than the other portions as the aluminum plate is being wound, forming so-called protruding edge portions. Deformation is caused at these portions, and the quality of the products may deteriorate.

Further, in a single side treatment, the degree of wear of the electrode at the untreated side is greater than that of the electrode at the untreated side. Although there is a difference between the degrees of wear of the electrodes, the entire unit including the electrode which is not worn must be replaced since the electrodes 116 and 122 are not separable. This causes waste as well as increase in production costs for electrodes.

In view of the above described facts, a task of the present invention is to obtain a metal plate electrolyzation apparatus which facilitates replacement of electrodes and allows it to be carried out at a low cost, and to obtain an electrode for electrolyzing a metal plate which is utilized in this metal plate electrolyzation apparatus. Other tasks of the present invention are to obtain a metal plate electrolyzation apparatus which facilitates switching between a single side treatment and a double side treatment, does not cause waste of electrodes nor deterioration of the quality of products in a single side treatment and has high energy efficiency, and to obtain an electrode for electrolyzing a metal plate which is utilized in this metal plate electrolyzation apparatus.

SUMMARY OF THE INVENTION

In order to solve the above described tasks, a first aspect of an electrode device relating to the present invention is a device for use in electrolyzing a metal sheet conveyed through an electrolyte along a path of travel having opposite sides, the device including: (a) a first electrode plate disposed substantially parallel to, and facing one side of the path of travel; (b) a second electrode plate disposed substantially parallel to, and facing the opposite side of the path of travel; and (c) a switching element positionable at a location electrically insulating the electrode plates from one another, and at another location for electrically connecting the electrode plates to one another.

Another aspect of an electrode device relating to the present invention is a device for use in electrolyzing a metal sheet conveyed through an electrolyte along a path of travel having opposite sides, the device including: (a) a first electrode plate disposed substantially parallel to, and facing one side of the path of travel; (b) a second electrode plate disposed substantially parallel to, and facing the opposite side of the path of travel; and (c) a fastener detachably connecting the electrodes to one another.

An aspect of an electrolyzation apparatus relating to the present invention is an apparatus for electrolyzation of a metal sheet using an electrolyte, the apparatus including: (a) a container for containing electrolyte; (b) a conveyor operable for transporting a metal sheet for electrolyzation through the container along a path of travel through electrolyte in the container, the path of travel having opposite sides; (c) a first electrode disposed substantially parallel to, and facing, one side of the path of travel; (d) a second electrode disposed substantially parallel to, and facing, the opposite side of the path of travel; (e) a switching element positionable at a location electrically insulating the electrode plates from one another, and at another location for electrically connecting the electrode plates to one another; and (f) a power source for electrically energizing the electrode plates.

DESCRIPTION OF THE PREFERRED EMBODIMENTS

Figure 1:
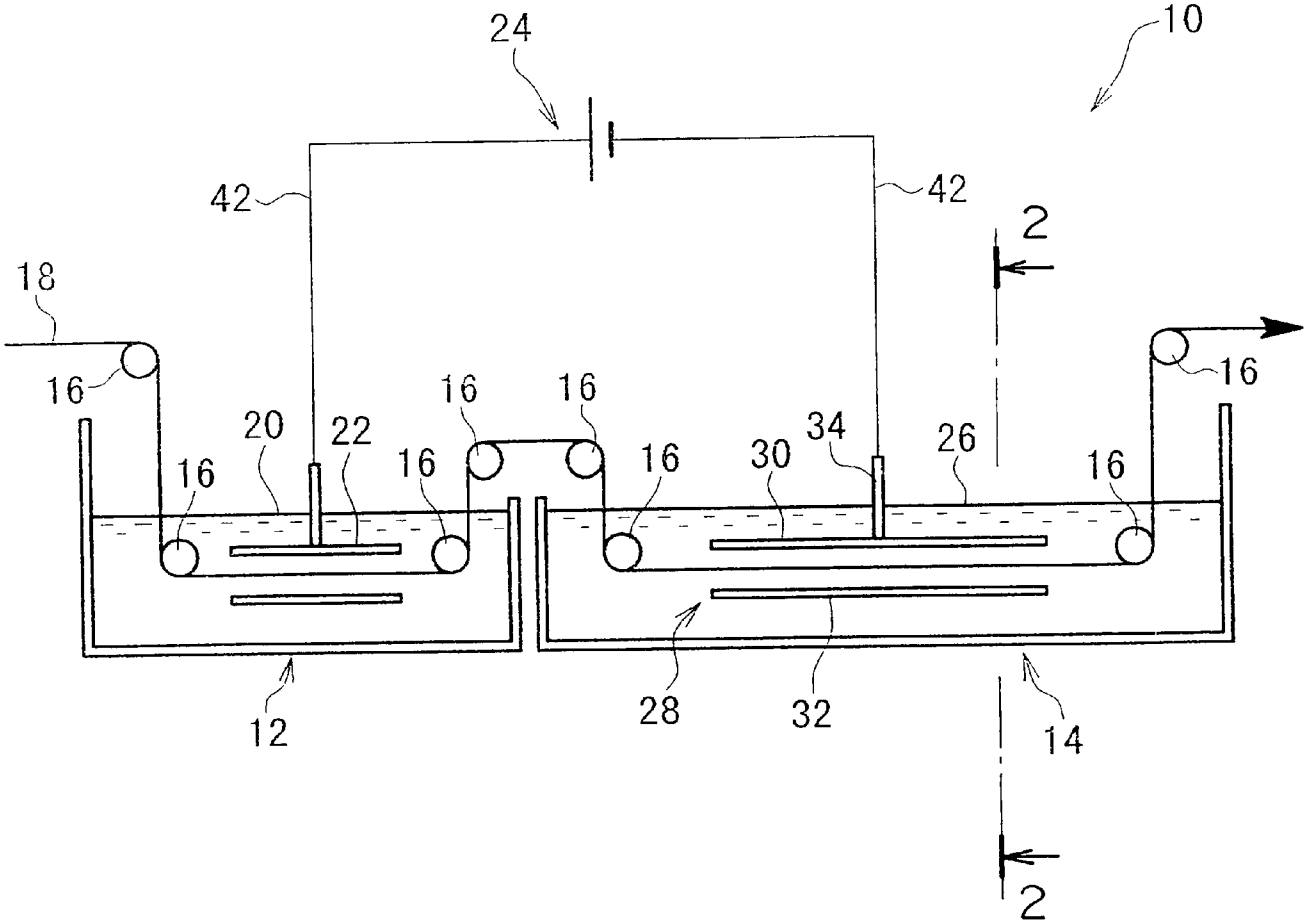
FIG. 1 is a schematic structural view showing a metal plate electrolyzation apparatus of a first embodiment of the present invention.
Figure 2:
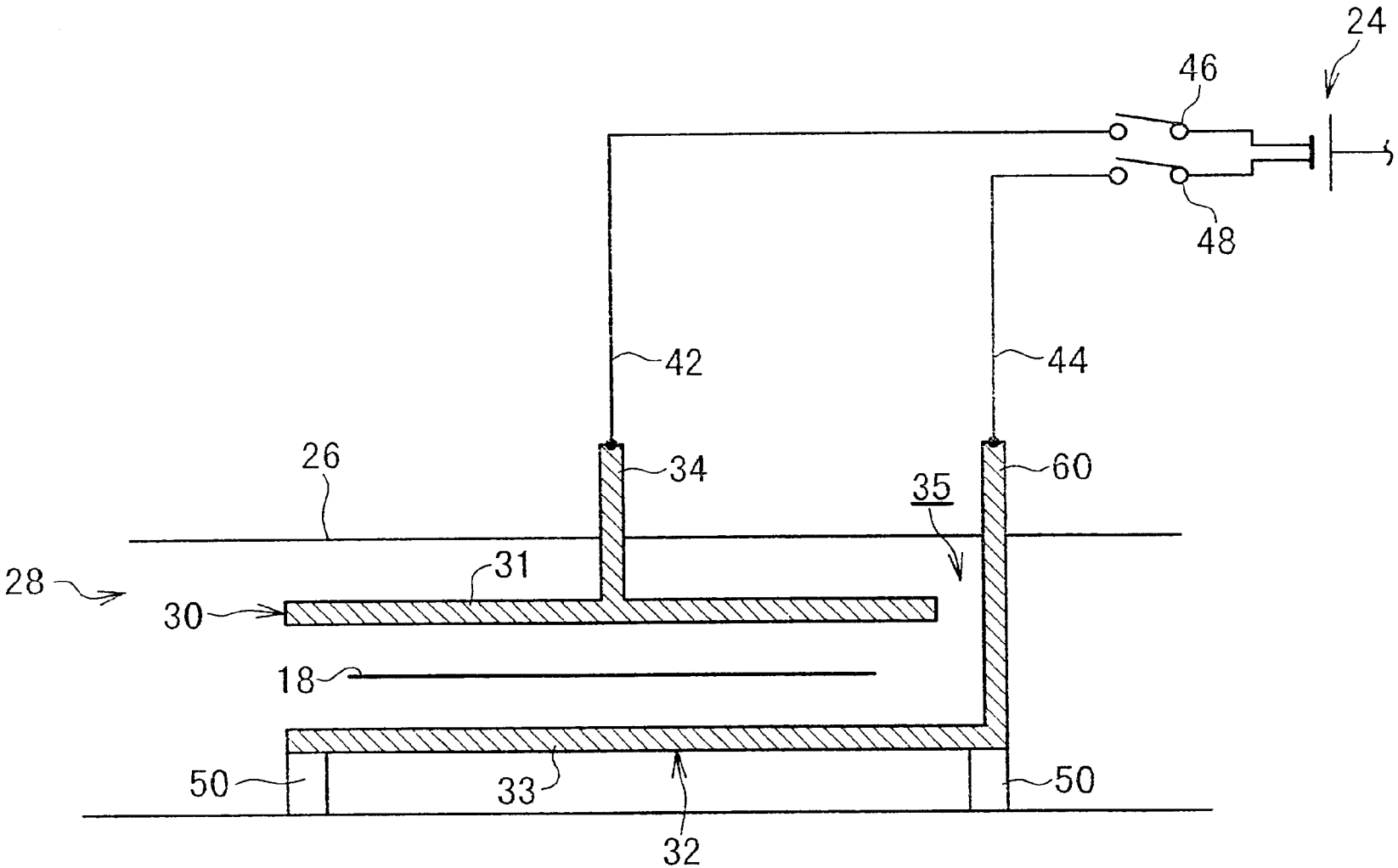
FIG. 2 is a sectional view showing an oxidation electrode of the metal plate electrolyzation apparatus of the first embodiment of the present invention.

FIG. 1 shows a schematic structure of a metal plate electrolyzation apparatus 10 of a first embodiment of the present invention. FIG. 2 is a cross-sectional view taken along line 2—2 of FIG. 1, showing an oxidation electrode 28 of the metal plate electrolyzation apparatus 10.

As shown in FIG. 1, the metal plate electrolyzation apparatus 10 includes a feeder bath 12 and an anodizing bath 14 which are placed side by side. A metal plate (a belt-like aluminum plate 18 is an example in the present embodiment), which has been subjected to a necessary pretreatment, is conveyed in the feeder bath 12 and the anodizing bath 14 while being suspended by a plurality of rollers 16.

The feeder bath 12 contains feeder electrolyte 20. The aluminum plate 18 is conveyed in a state in which it is immersed in this feeder electrolyte 20. In the feeder electrolyte 20, a feeder electrode 22 is provided which is connected to an anode of a power supply 24 via a bus bar 42 and is held in a predetermined position so as to face and be in parallel with both sides or one side (both sides in FIG. 1) of the aluminum plate 18 being conveyed. The aluminum plate 18 acts as a cathode by being conveyed in the feeder electrolyte 20 in a state in which it faces the feeder electrode 22.

On the other hand, the anodizing bath 14 contains the electrolyte 26, and the aluminum plate 18 sent from the feeder bath 12 is conveyed in a state in which it is immersed in the electrolyte 26. As shown in detail in FIG. 2, the oxidation electrode 28 is provided in the anodizing bath 14.

The oxidation electrode 28 has a front-surface-side electrode member 30 placed at the front surface side (upper side) of the aluminum plate 18 being conveyed and a back-surface-side electrode member 32 placed at the back surface side (lower side) of the aluminum plate 18. The front-surface-side electrode member 30 is formed of a front-surface-side electrode portion 31 which is placed in parallel with the aluminum plate 18; and a connecting portion 34 which protrudes upward from a substantially central portion of the upper portion of the front-surface-side electrode portion 31, the upper end of the connecting portion 34 being positioned above the liquid level of the electrolyte 26. The connecting portion 34 and a cathode of the power supply 24 is connected via the bus bar 42 (see FIG. 1), and the front-surface-side electrode member 30 is held in a predetermined position.

On the other hand, the back-surface-side electrode member 32 is formed of a back-surface-side electrode portion 33 which is placed in parallel with the aluminum plate 18; and a connecting portion 60 which protrudes upward from a width-direction end of the back-surface-side electrode portion 33, the upper end of the connecting portion 60 being positioned above the liquid level of the electrolyte 26. The connecting portion 60 is positioned so as not to contact the front-surface-side electrode member 30 and thus an insulating gap 35 is formed between the front-surface-side electrode member 30 and the back-surface-side electrode member 32. The connecting portion 60 and the cathode of the power supply 24 is connected via a bus bar 44 (see FIG. 2). The back-surface-side electrode portion 33 is supported at a predetermined position by supporting blocks 50 which are provided so as to stand at the bottom portion of the anodizing bath 14.

Switches 46 and 48 are provided respectively to the bus bars 42 and 44. The front-surface-side electrode member 30 and the back-surface-side electrode member 32 can be independently turned on and off by opening and closing of the switches 46 and 48.

Although FIG. 1 shows the feeder bath 12 and the anodizing bath 14 which are formed separately, these baths may be formed integrally and separated by a partition wall. In this case, a through hole is formed in the partition wall, and the aluminum plate 18 can be conveyed from the feeder bath 12 to the anodizing bath 14 through this through hole. On the other hand, in a case in which the feeder bath 12 and the anodizing bath 14 are separately formed as shown in FIG. 1, amounts or compositions of the feeder electrolyte 20 and the electrolyte 26 can be finely adjusted or replenished for each bath.

Operation of the metal plate electrolyzation apparatus 10 of the present invention is explained next.

The aluminum plate 18 which has been subjected to a necessary pretreatment is suspended on the rollers 16 and conveyed in a state in which it is immersed in the feeder electrolyte 20 in the feeder bath 12. At this time, the aluminum plate 18 is conveyed facing the feeder electrode 22 which is connected to the anode of the power supply 24 and acts as a cathode.

The aluminum plate 18 is further conveyed by the rollers 16, and conveyed in a state in which it is immersed in the electrolyte 26 in the anodizing bath 14. At this time, since the aluminum plate 18 is conveyed with the front surface and the back surface thereof respectively facing the front-surface-side electrode member 30 and the back-surface-side electrode member 32 which are connected to the cathode of the power supply 24, the aluminum plate 18 acts as an anode and the both sides thereof are oxidized to form oxide coatings.

Figure 5:
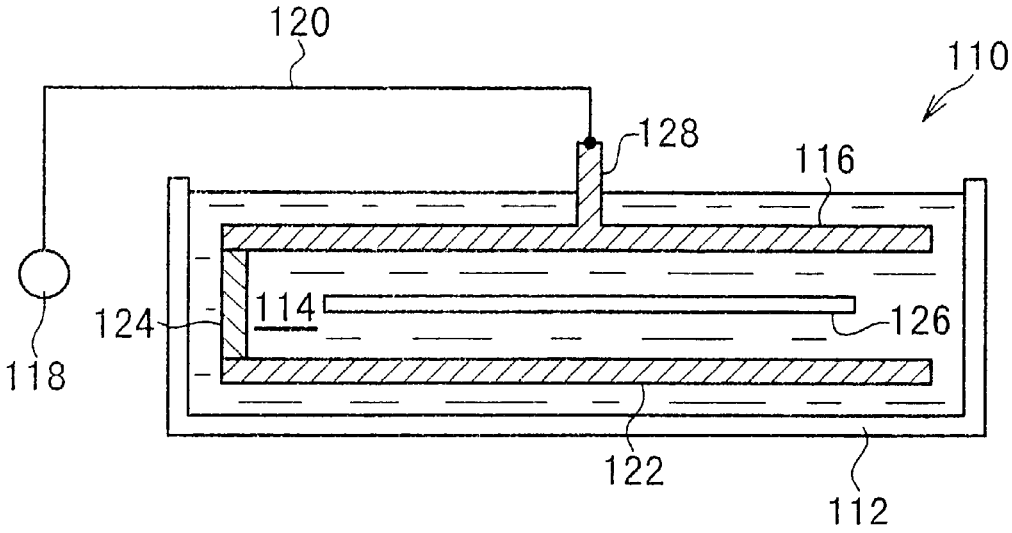
FIG. 5 (PRIOR ART)
FIG. 5 is a sectional view partially showing a conventional metal plate electrolyzation apparatus.

The oxidation electrode 28 is gradually worn as a result of such an anodic oxidation treatment, and it must be replaced after a certain period of treatment. In the metal plate electrolyzation apparatus 10 of the present embodiment, the oxidation electrode 28 is formed of the front-surface-side electrode member 30 and the back-surface-side electrode member 32. That is, the oxidation electrode 28 is separated into two members. Replacement of the front-surface-side electrode member 30 and the back-surface-side electrode member 32 with new ones is facilitated by replacing them separately, since the aluminum plate 18 and the structures (not shown) provided in the anodizing bath do not hinder the replacement in this case. In addition, the front-surface-side electrode member 30 and the back-surface-side electrode member 32 do not damage the aluminum plate 18 by contacting it during replacement. Particularly, the replacement operation can be carried out in a shorter time period and with less labor as compared to that for a conventional one such as shown in FIG. 5 wherein a front-surface-side electrode and a back-surface-side electrode are integrally formed, and is thus excellent in operational efficiency. Since each of the front-surface-side electrode member 30 and the back-surface-side electrode member 32 can be made lighter than a conventional integral-type electrode, safety during a replacement operation can be improved.

Further, in the metal plate electrolyzation apparatus 10 of the present embodiment, by opening or closing a desired one of the independently provided switches 46 and 48, the front-surface-side electrode member 30 and the back-surface-side electrode member 32 can be independently turned on or off to form an oxide coating on only one side of the aluminum plate 18 (single side treatment). The single side treatment is thereby facilitated since there is no need to provide an insulation member between the aluminum plate 18 and the electrode on the side on which an oxide coating is not formed. Even when there is a switch between the single side treatment and the double side treatment, there is no need to place or remove an insulation member, and therefore the switching operation is very easy (only opening and closing of the switches).

When a single side treatment is carried out, an electric current is sent only to the electrode member which requires it (either one of the front-surface-side electrode member 30 and the back-surface-side electrode member 32) and not to both of the electrodes. Therefore, there is no waste of electric power compared with a conventional one, and the energy efficiency is higher.

In addition, since an electric current is not applied to the electrode member at the untreated side in a case of a single side treatment, this electrode member does not act as an electrode and an amount of an oxide coating formed after treatment in the vicinity of both width-direction ends at the untreated side of the aluminum plate 18 can be significantly reduced. Therefore, when the aluminum plate 18 which has been subjected to treatment is wound, protruding edge portions are not formed and no deformation is caused, thereby maintaining the quality of the aluminum plate 18.

Further, when a single side treatment is carried out using a metal plate electrolyzation apparatus of a conventional type wherein an integral electrode member is provided corresponding to both sides of the aluminum plate 18, an electric current also flows to an electrode at an unelectrolyzed side and a degree of wear of this electrode becomes relatively high. However, since the electrode member which is not worn is replaced along with the worn electrode member, waste is caused and large expenses are incurred in the production of electrode members. On the other hand, when a single side treatment is carried out using the metal plate electrolyzation apparatus 10 of the present invention, only the electrode member which is highly worn is replaced. Therefore, waste is not caused and production of the electrodes is less costly.

Figure 3:
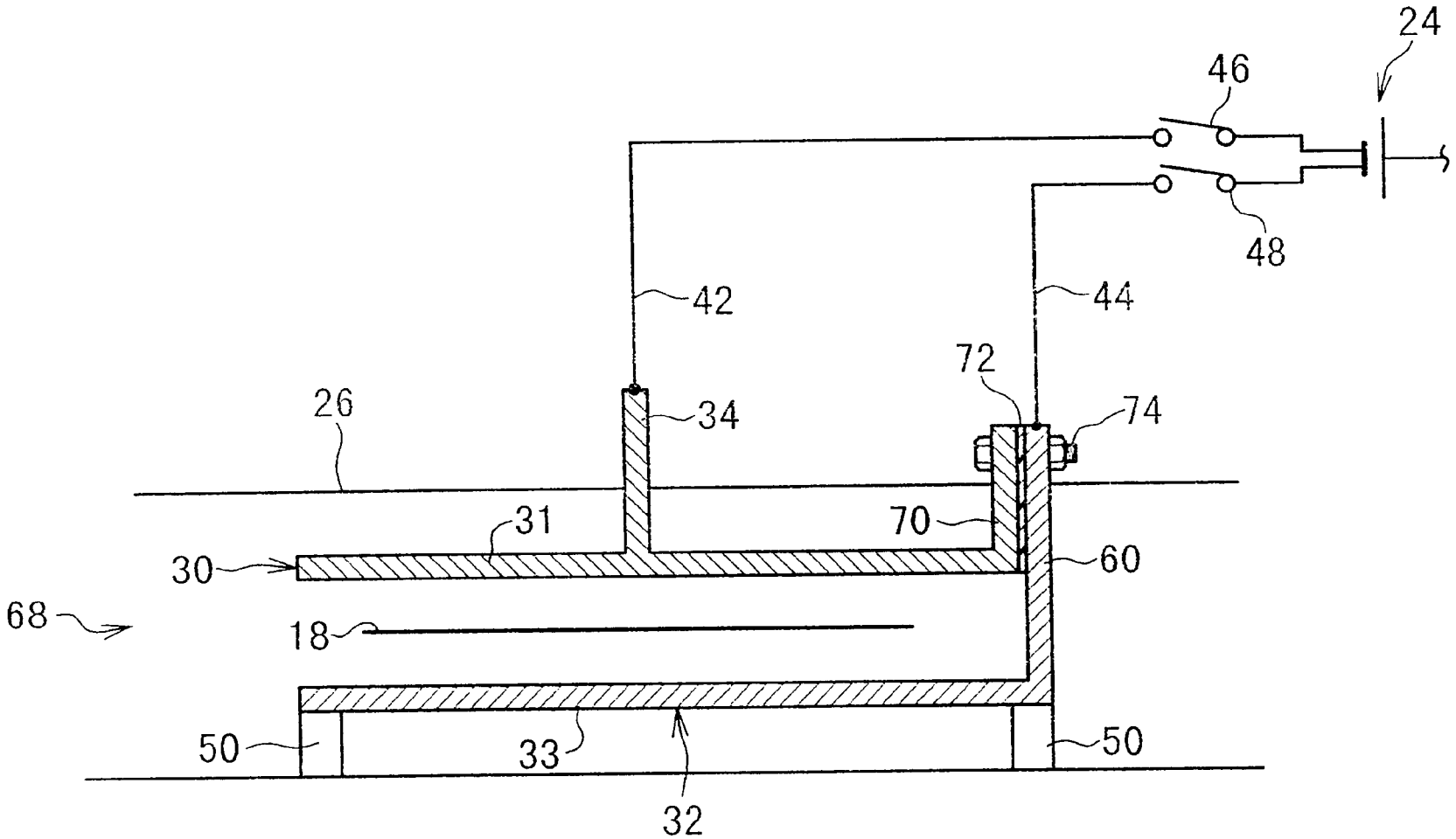
FIG. 3 is a sectional view showing an oxidation electrode of a metal plate electrolyzation apparatus of a second embodiment of the present invention.

FIG. 3 shows an oxidation electrode 68 which forms a metal plate electrolyzation apparatus of a second embodiment of the present invention. The same reference numerals are used for elements, members and the like, which are the same as those in the first embodiment, and therefore explanations for them are omitted.

In the oxidation electrode 68 of the second embodiment, a fixing portion 70, which projects upward from a width-direction end of a front-surface-side member 30 with the upper end thereof being positioned above a liquid level of a electrolyte 26, is formed. The fixing portion 70 and a connecting portion 60 of a back-surface-side electrode member 32 are fixed by a bolt 74 with an insulation plate 72 being sandwiched therebetween. This bolt 74 is also subjected to an insulating treatment, and therefore the front-surface-side member 30 and the back-surface-side electrode member 32 are insulated. Remaining portions are formed with the same structure as in the first embodiment. A material of the insulation plate 72 is not particularly limited as long as it can insulate the fixing portion 70 and the connecting portion 60. A structure in which the insulation is effected by an insulating gap 35 as in the first embodiment is also acceptable.

In the second embodiment formed with such a structure, since the front-surface-side member 30 and the back-surface-side electrode member 32 are fixed by the bolt 74, their relative positions are kept constant and an oxidation treatment can be carried out more stably. Further, since a portion of the load of the front-surface-side member 30 acts on supporting blocks 50 via the back-surface-side electrode member 32, the load which acts on a bus bar 42 is reduced.

As in the first embodiment, the front-surface-side member 30 and the back-surface-side electrode member 32 are insulated and can be turned on and off independently from each other by switches 46 and 48. Therefore, energy efficiency in a case of a single side treatment is improved and the problem where only an electrode at an untreated side is highly worn does not occur. When the aluminum plate 18 which has been subjected to treatment is wound in a roll, there is no deformation caused by protruding edge portions and a constant quality is maintained.

Upon replacement of the oxidation electrode 68 of the second embodiment, the bolt 74 is removed to make the front-surface-side electrode member 30 and the back-surface-side electrode member 32 separable. At this time, the bolt 74 can be easily removed since the bolt 74 is positioned higher than the liquid level of the electrolyte 26. Thereafter, the oxidation electrode 68 can be replaced in the same manner as the first embodiment, so that the operational efficiency is excellent.

Figure 4:
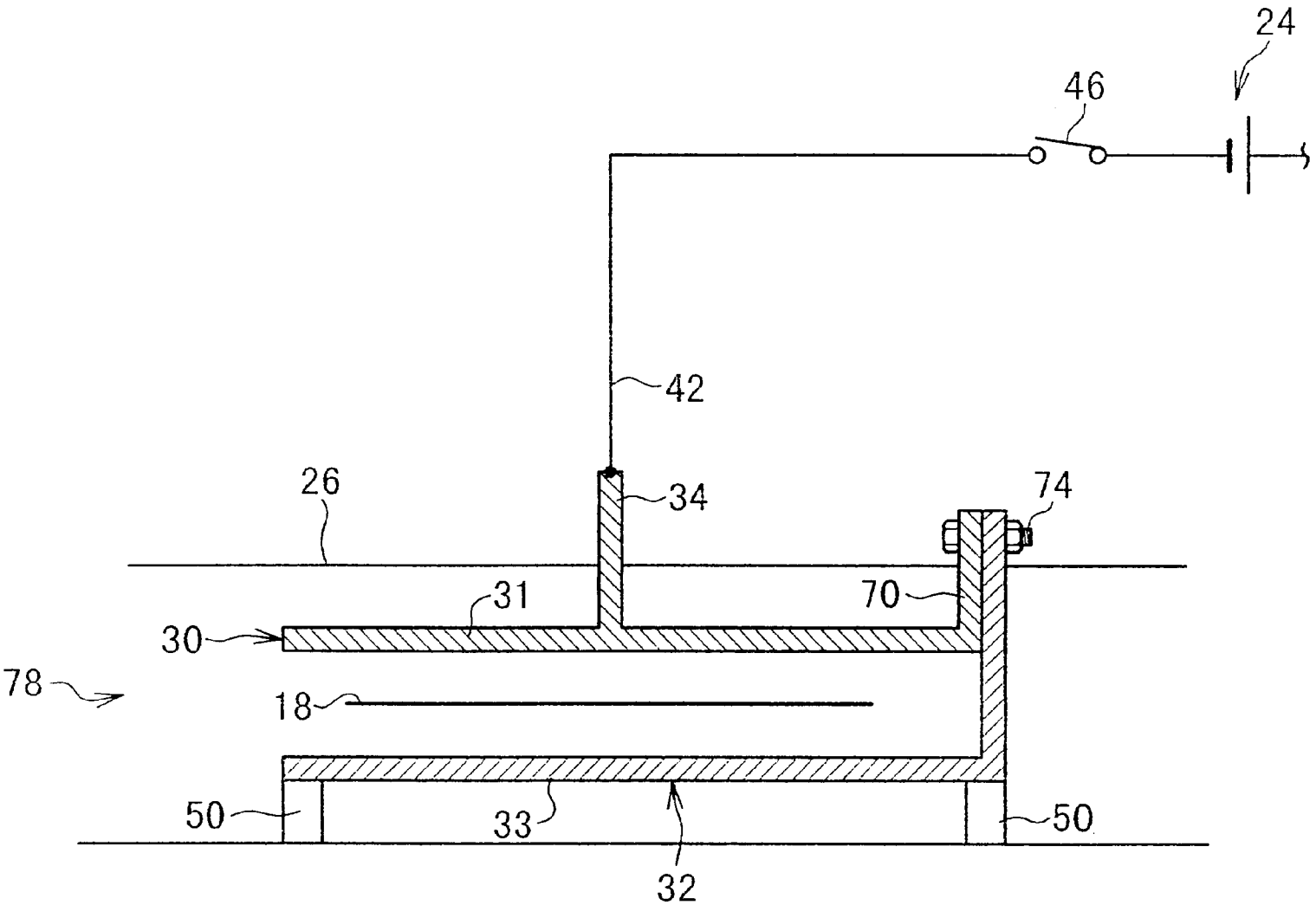
FIG. 4 is a sectional view showing an oxidation electrode of a metal plate electrolyzation apparatus of a third embodiment of the present invention.

FIG. 4 shows an oxidation electrode 78 of a metal plate electrolyzation apparatus of a third embodiment of the present invention. The same reference numerals are used for elements, members and the like, which are the same as those in the second embodiment, and therefore explanations for them are omitted.

In the oxidation electrode 78 of the third embodiment, an insulation plate 72 is not sandwiched between a fixing portion 70 of a front-surface-side member 30 and a connecting portion 60 of a back-surface-side electrode member 32, and the fixing portion 70 and the connecting portion 60 are fixed by a bolt 74 in a state in which they contact each other. Therefore, the front-surface-side electrode member 30 and the back-surface-side electrode member 32 are not insulated. In addition, a bus bar 44 and a switch 48 (see FIG. 2 for either of them) for the back-surface-side electrode member 32 are not provided, and the front-surface-side electrode member 30 and the back-surface-side electrode member 32 are turned on and off together by the opening and closing of a switch 46. Remaining portions are formed with the same structure as in the second embodiment.

Also in the third embodiment formed with such a structure, since the front-surface-side electrode member 30 and the back-surface-side electrode member 32 are fixed by the bolt 74, their relative positions are kept constant and an oxidation treatment can be carried out more stably, and a load of the front-surface-side member 30 which acts on a bus bar 42 is reduced as in the second embodiment. In addition, by removing the bolt 74 to make the front-surface-side electrode member 30 and the back-surface-side electrode member 32 separable, the oxidation electrode 78 can be replaced in the same manner as in the first and second embodiments, so that the operational efficiency is excellent.

Although an anodizing oxidation which forms an oxide coating on the aluminum plate 18 is explained above as an example of an electrolyzation, the type of electrolyzation and a metal plate which is to be electrolyzed are not limited to these. Any metal plate can be used as the metal plate to be electrolyzed. Further, the type of the electrolyzation is not limited to a treatment which forms oxide coatings on a metal plate. For example, the present invention may be applied to such a treatment which carries out electrolytic plating. This can be accomplished, for example, by changing the manner in which the power supply 24 and the like are connected.

Materials which form the electrode for electrolyzing a metal plate (the oxidation electrode 28) of the present invention are also not particularly limited as long as they conduct electricity. However, if the electrode is formed of the same main component as that of the metal plate to be treated, change in the composition of the electrolyte for the electrolyzation can be minimized and the electrolyzation can be effected stably for a long time period.

Finally, a fourth embodiment of the present invention is explained in detail.

In the fourth embodiment, the metal plate electrolyzation apparatus of the first embodiment was used for an anodic oxidation process which is a part of a production process of a planographic printing plate (presensitized plate).

In a production process of a planographic printing plate, predetermined surface treatments are performed on an aluminum plate for planographic printing. First, these surface treatment processes are explained.

The surface treatment processes (1) to (7) described below are to illustrate basic processes only. In practice, washing (rinsing) processes using spray or the like are carried out between the processes to wash away residual fluid from the previous process, however, these intermediate processes are not described here.

First, an untreated aluminum plate was subjected to a mechanical surface roughening process (1). The surface roughening was effected by spraying slurry aqueous solution of an abrasive powder such as pumice, silica sand or alumina onto a surface of the aluminum plate, and rubbing the surface with a nylon brush. By this mechanical surface roughening treatment, a concavo-convex structure of a wavelength between 10 and 20 $\mu$m was formed.

Subsequently, an etching process (2) was carried out in order to smooth the concavo-convex structure surface obtained by the surface roughening process (1) to prevent ink from over adhering to the surface of the printing material at the time of printing to prevent staining. In the present embodiment, an etching treatment of 1 to 20 g/m$^2$ was performed on the surface of the aluminum plate by spraying it with NaOH solution.

Next, in a pickling process (3), aluminum hydroxide called smut, which was generated and deposited on the surface of the aluminum plate when the etching was carried out, was removed by pickling with nitric acid.

Then, in an electrolytic surface roughening process (4), a surface roughening was carried out electrolytically in order to form an even smaller concavo-convex structure of a wavelength between 1 and 4 $\mu$m. A rectangular wave alternating current of 60 Hz frequency was used for a power supply.

Subsequently, in an etching process (5), the surface was slightly (about 0.1 to 3 g/m$^2$) etched to remove smut generated in the electrolytic surface roughening process (4), as well as to control the concavo-convex configuration (topology) of the surface. NaOH solution was used as the etching solution.

Next, in a pickling process (6), smut generated in the etching process (5) was pickled with nitric acid and removed. Through the above processes (1) to (6), a concavo-convex structure was formed with high precision on the aluminum surface.

Then, in an anodic oxidation process (7), in order to provide abrasion resistance, an oxide coating was formed on the concavo-convex surface using the metal plate electrolyzation apparatus of the present invention. A direct current was used for a power supply and sulfuric acid was used as an electrolyte. An oxide coating of an amount of 1 to 4 g/m$^2$ was formed.

The surface treatment processes described above are completed and a support material for a planographic printing plate is obtained. Photosensitive layers in accordance with their purpose are formed by being coated and dried on the obtained support material, and then cut in predetermined dimensions to prepare planographic printing plates.

First, only the switch 46 was closed and an electric current was applied only to the front-surface-side electrode member 30 to perform a single side treatment. On comparing power consumption at this time with that of a conventional integral type electrode (see FIG. 5), it was found that power consumption was reduced by 10 to 20%.

When a particularly thick oxide coating (3.0 g/cm$^2$) was formed on the aluminum plate 18 and the aluminum plate 18 was wound in a roll, so-called protruding edge portions were not created and no deformation was caused in the vicinity of the ends of the aluminum plate 18.

Then, in this metal plate electrolyzation apparatus, a replacement operation of at least one of the front-surface-side electrode member 30 and the back-surface-side electrode member 32 was carried out, and a time required for this replacement operation was compared with a time required for a replacement of a conventional integral type electrode. The results are shown in Table 1.

TABLE 1

| Electrode to be Replaced | Time Required for Replacement of Electrode (Relative to Integral Type Electrode) |
|---|---|
| Front-surface-side Electrode Member | 1/6 |
| Back-surface-side Electrode Member | 1/3 |
| Both | 1/2 |

As can be seen from Table 1, even when replacing both of the front-surface-side electrode member 30 and the back-surface-side electrode member 32, the operation time is reduced to ½ of the operation time for the integral type electrode. Further, when replacing only one of the electrode members, the operation time is further reduced. Particularly, when replacing only the front-surface-side electrode member 30, the operation time is significantly reduced in comparison with that for the integral type electrode.

Cost of production of the electrode for electrolyzing a metal plate of the present embodiment was reduced by about 60% when compared with that for a conventional integral type electrode and thus there was a significant effect in a view of reduction of production costs.

What is claimed is:

1. A device for use in electrolyzing a metal sheet conveyed through an electrolyte along a path of travel having opposite sides, the device comprising:

(a) a first electrode plate disposed substantially parallel to, and facing one side of the path of travel;

(b) a second electrode plate disposed substantially parallel to, and facing the opposite side of the path of travel; and (c) a switching element positionable at a location electrically insulating the electrode plates from one another, and at another location for electrically connecting the electrode plates to one another.

2. A device according to claim 1, wherein the electrode plates are separately formed from one another.

3. A device according to claim 1, wherein the metal sheet and electrodes each have a main component, that is substantially identical.

4. A device according to claim 1, wherein the switching element is one of, an electrically insulative member removably fastenable between the plates, and an electric switch.

5. A device for use in electrolyzing a metal sheet conveyed through an electrolyte along a path of travel having opposite sides, the device comprising:

(a) a first electrode plate disposed substantially parallel to, and facing one side of the path of travel;

(b) a second electrode plate disposed substantially parallel to, and facing the opposite side of the path of travel; and (c) a fastener detachably connecting the electrodes to one another.

6. A device according to claim 5, wherein the electrode plates are independently energizable.

7. A device according to claim 6, further comprising an insulative member removably interposable between the electrode plates, electrically insulating the electrode plates from one another.

8. A device according to claim 5, wherein the metal sheet and electrodes each have a main component, that is substantially identical.

9. A device according to claim 5, wherein the fastener includes a threaded portion.

10. An apparatus for electrolyzation of a metal sheet using an electrolyte, the apparatus comprising:

(a) a container for containing electrolyte;

(b) a conveyor operable for transporting a metal sheet for electrolyzation through the container along a path of travel through electrolyte in the container, the path of travel having opposite sides;

(c) a first electrode disposed substantially parallel to, and facing, one side of the path of travel;

(d) a second electrode disposed substantially parallel to, and facing, the opposite side of the path of travel;

(e) a switching element positionable at a location electrically insulating the electrode plates from one another, and at another location for electrically connecting the electrode plates to one another; and (f) a power source for electrically energizing the electrode plates.

11. An apparatus according to claim 10, wherein the electrode plates are independently energizable.

12. An apparatus according to claim 11, wherein the electrode plates are separately formed from one another.

13. An apparatus according to claim 11, wherein the metal sheet and electrodes each have a main component, that is substantially identical.

14. An apparatus according to claim 10, further comprising a fastener detachably connecting the electrodes to one another.

15. An apparatus according to claim 14, further comprising an insulative member removably interposable between the electrode plates, electrically insulating the electrode plates from one another.

16. An apparatus according to claim 14, wherein the fastener includes a threaded portion.

17. An apparatus according to claim 10, wherein the power source includes:

(a) opposite poles;

(b) a first connecting line for electrically connecting one pole of the power source to the first electrode plate; and (c) a second connecting line for electrically connecting the one pole of the power source to the second electrode plate.

18. An apparatus according to claim 17, wherein the power source further includes a first switch provided on the first connecting line, and a second switch provided on the second connecting line, each switch being operable via its respective connecting line for electrically connecting and disconnecting the one pole of the power source to an electrode plate.

19. An apparatus according to claim 10, further comprising another container for containing electrolyte, with one container serving as a feeder bath and the other container serving as an electrolyzing bath.

20. An apparatus according to claim 10, wherein the containers are integrated with one another.

* * * * *